US010347452B2

(12) United States Patent
Tsutsumi et al.

(10) Patent No.: US 10,347,452 B2
(45) Date of Patent: Jul. 9, 2019

(54) POLARIZED DC ELECTROMAGNETIC DEVICE AND ELECTROMAGNETIC CONTACTOR USING SAME

(71) Applicant: FUJI ELECTRIC FA COMPONENTS & SYSTEMS CO., LTD., Tokyo (JP)

(72) Inventors: Takashi Tsutsumi, Kounosu (JP); Masaaki Watanabe, Kounosu (JP); Hideki Daijima, Kounosu (JP); Shota Shiinoki, Kounosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 421 days.

(21) Appl. No.: 15/185,546

(22) Filed: Jun. 17, 2016

(65) Prior Publication Data

US 2016/0293370 A1 Oct. 6, 2016

Related U.S. Application Data

(63) Continuation of application No. PCT/JP2015/001948, filed on Apr. 7, 2015.

(30) Foreign Application Priority Data

May 20, 2014 (JP) ..... 2014-104750

(51) Int. Cl.
*H01H 51/22* (2006.01)
*H01H 50/14* (2006.01)
(Continued)

(52) U.S. Cl.
CPC ..... *H01H 51/2209* (2013.01); *H01H 50/14* (2013.01); *H01H 50/20* (2013.01); *H01H 50/36* (2013.01); *H01H 50/641* (2013.01)

(58) Field of Classification Search
CPC ..... H01H 51/22; H01H 14/20; H01H 14/36
(Continued)

(56) References Cited

U.S. PATENT DOCUMENTS 4,978,935 A * 12/1990 Hoffman ..... H01H 51/01 335/121
4,994,776 A * 2/1991 Juncu ..... H01F 7/1615 335/230
(Continued)

FOREIGN PATENT DOCUMENTS

CN 102265369 A 11/2011
JP 2008-300328 12/2008
(Continued)

OTHER PUBLICATIONS

International Search Report dated Jun. 30, 2015, in corresponding International Application No. PCT/JP2015/001948.
(Continued)

*Primary Examiner* — Shawki S Ismail
*Assistant Examiner* — Lisa N Homza

(57) ABSTRACT

A polarized DC electromagnetic device and electromagnetic contactor using same to improve assembly efficiency without size increase of the electromagnetic device. The device includes a plunger inserted through a cylindrical portion of a spool around which an excitation coil is wound and having a first armature and a second armature attached to both ends, an outer yoke attracting the first armature and the second armature, an inner yoke disposed inside the outer yoke and attracting the second armature, and a permanent magnet disposed between the outer yoke and the inner yoke. The spool includes radially protruding flange portions respectively formed at both ends of the cylindrical portion, a coil
(Continued)

terminal attachment portion formed in the flange portion on the first armature side, and a coil terminal attached to the coil terminal attachment portion.

4 Claims, 11 Drawing Sheets

(51) Int. Cl.
*H01H 50/20* (2006.01)
*H01H 50/36* (2006.01)
*H01H 50/64* (2006.01)

(58) Field of Classification Search
USPC ..... 335/81
See application file for complete search history.

(56) References Cited

U.S. PATENT DOCUMENTS 5,272,458 A * 12/1993 Hoffman ..... H01H 51/2209 335/179
6,392,516 B1 * 5/2002 Ward ..... H01F 7/081 335/220
7,157,996 B2 * 1/2007 Enomoto ..... H01H 50/02 335/126
7,633,361 B2 * 12/2009 Raklyar ..... H01P 1/125 200/16 R
8,008,999 B2 * 8/2011 Morimura ..... H01H 51/2227 335/129
8,395,463 B2 * 3/2013 Ito ..... H01H 9/34 335/78
8,653,917 B2 * 2/2014 Takaya ..... H01H 9/443 335/126
9,368,266 B2 * 6/2016 Maller ..... H01F 7/1607
10,026,576 B2 * 7/2018 Tsutsumi ..... H01H 50/60
2006/0023390 A1 * 2/2006 Spurr ..... E05B 81/14 361/160
2008/0164963 A1 * 7/2008 Tominaga ..... H02K 41/0356 335/222
2008/0204174 A1 * 8/2008 Ito ..... H01F 7/066 335/222
2010/0026427 A1 * 2/2010 Moeller ..... H01H 1/2083 335/71
2012/0133460 A1 5/2012 Okubo et al.
2012/0133462 A1 5/2012 Naka et al.
2012/0161908 A1 * 6/2012 Naka ..... H01F 7/1615 335/78
2014/0055223 A1 * 2/2014 Sumino ..... H01F 41/06 335/229
2015/0213987 A1 * 7/2015 Sasaki ..... H01H 51/2209 335/78
2016/0189901 A1 * 6/2016 Tsutsumi ..... H01H 50/60 335/84

FOREIGN PATENT DOCUMENTS

JP 2011-44278 3/2011
JP 2011-44280 3/2011

OTHER PUBLICATIONS

Chinese Office Action dated May 4, 2017 in Corresponding Chinese Patent Application No. 201580003209.6.
International Preliminary Report on Patentability dated Dec. 1, 2016 in corresponding to International Patent Application No. PCT/JP2015/001948.

* cited by examiner

POLARIZED DC ELECTROMAGNETIC DEVICE AND ELECTROMAGNETIC CONTACTOR USING SAME

CROSS-REFERENCE TO RELATED APPLICATIONS

This application is a continuation application filed under 35 U.S.C. § 111(a), of International Application PCT/JP2015/001948, filed Apr. 7, 2015, and claims foreign priority benefit to Japanese Patent Application No. 2014-104750, filed May 20, 2014, the contents of which are incorporated herein by reference.

TECHNICAL FIELD

The present invention relates to a polarized DC electromagnetic device having an outer yoke attached to the outside of a spool around which an excitation coil is wound and having a plunger inserted through the spool, and an electromagnetic contactor using this device.

BACKGROUND ART

As a coil terminal of an electromagnetic device, for example, an electromagnetic contactor described in Patent Literature 1 is known.

This coil terminal has a configuration wherein a terminal block is integrally formed in a coil winding frame around which a coil is wound so that the terminal block laterally projects, and a terminal fitting having a lead wire connection portion is attached and fixed to the terminal block.

CITATION LIST

Patent Literature

PTL 1: JP 2008-300328 A

SUMMARY OF INVENTION

Technical Problem

Now, in the coil terminal described in Patent Literature 1 mentioned above, the terminal block is integrally formed in the coil winding frame around which the coil is wound, so that when a fixed core and a movable core are separate as in an alternating-current electromagnet, the movable core can be easily attached to the terminal block. However, when an outer yoke is disposed around the side surface of the coil winding frame as in a polarized DC electromagnet, there are unsolved problems that it takes time to attach the outer yoke to the terminal block and the assembly efficiency of the electromagnetic device deteriorates.

To improve the assembly efficiency of the electromagnetic device, the width dimension of the terminal block needs to be increased, which leads to the increase of the electromagnetic device in size.

Thus, the present invention has been developed in view of the unsolved problems of the above conventional example, and an object thereof is to provide a polarized DC electromagnetic device and an electromagnetic contactor using the same which can improve assembly efficiency without the increase of the electromagnetic device in size.

Solution to Problem

To achieve the above object, one configuration of a polarized electromagnet according to the present invention includes a spool around which an excitation coil is wound, a plunger which is inserted through a cylindrical portion of the spool and in which a first armature and a second armature are individually attached to both ends protruding from the cylindrical portion, an outer yoke which surrounds opposite side surfaces of the spool so as to attract the first armature and the second armature, an inner yoke disposed inside the outer yoke so as to attract the second armature, and a permanent magnet disposed between the outer yoke and the inner yoke. The spool includes radially protruding flange portions which are respectively formed at both ends of the cylindrical portion, a coil terminal attachment portion formed in the flange portion on the first armature side, and a coil terminal which is attached to the coil terminal attachment portion.

Furthermore, one configuration of an electromagnetic contactor according to the present invention uses the above polarized DC electromagnetic device as an operating electromagnet which performs an opening-closing operation of a movable contact of a contact mechanism.

Advantageous Effects of Invention

According to the present invention, a coil terminal attachment portion is formed in a spool so that a coil terminal is attached to this coil terminal attachment portion, and hence an outer yoke can be attached to the spool before the coil terminal is attached, and the coil terminal can be then attached to the coil terminal attachment portion, whereby it is possible to improve assembly efficiency without the increase of a polarized DC electromagnetic device in size.

Furthermore, regarding the configuration of an electromagnetic contactor, it is also possible to improve assembly efficiency without a size increase by using the polarized DC electromagnetic device which is improved in assembly efficiency without a size increase.

BRIEF DESCRIPTION OF DRAWINGS

FIG. 7A is a perspective view seen from an upper side, FIG. 7B is a front view.

FIG. 8A is a perspective view seen from a lower side, and FIG. 8B is a bottom view;

DESCRIPTION OF EMBODIMENTS

One embodiment of the present invention will now be described with reference to the drawings.

Figure 1:
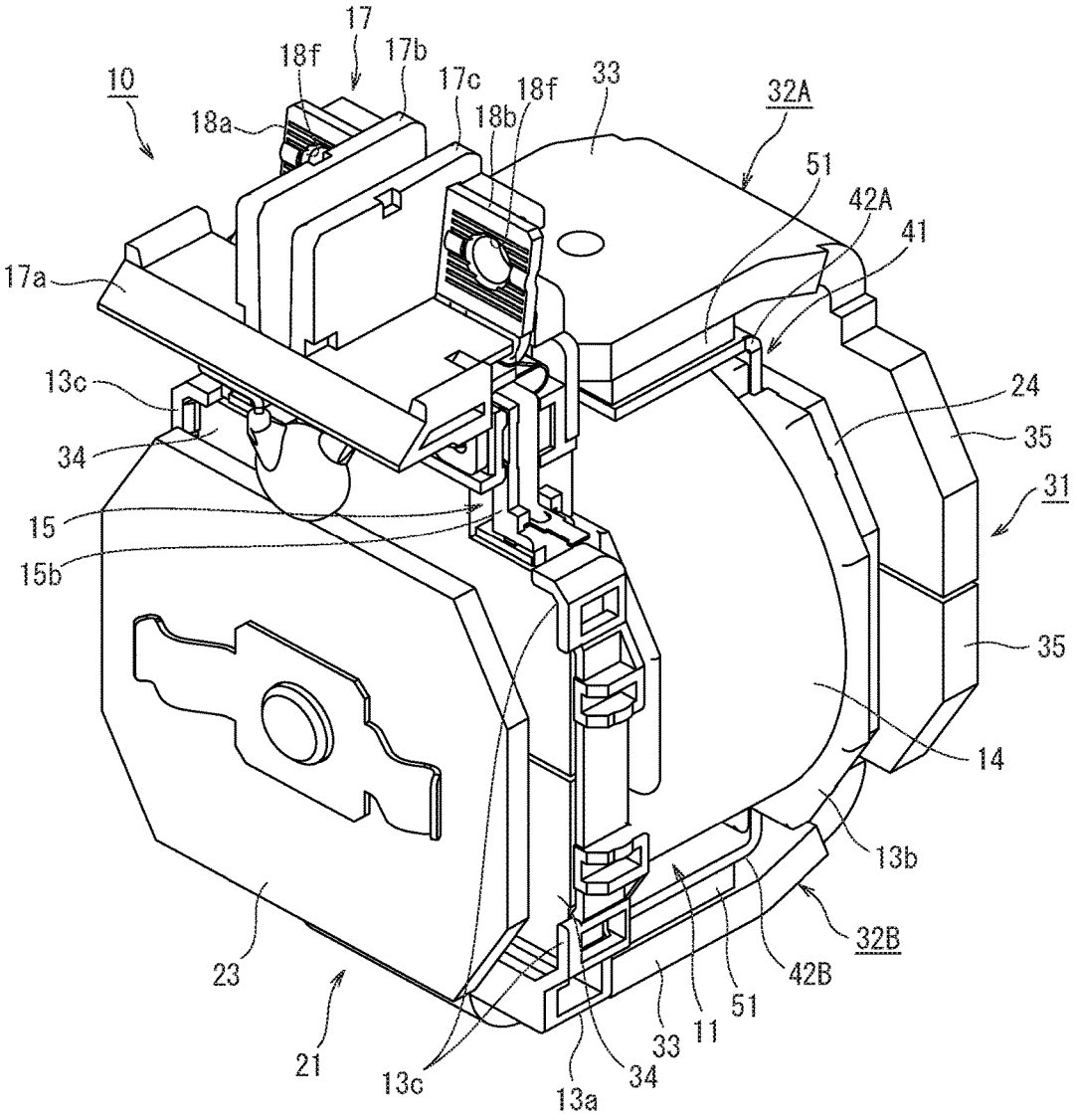
FIG. 1 is an appearance perspective view illustrative of one embodiment of a polarized DC electromagnetic device according to the present invention.
Figure 2:
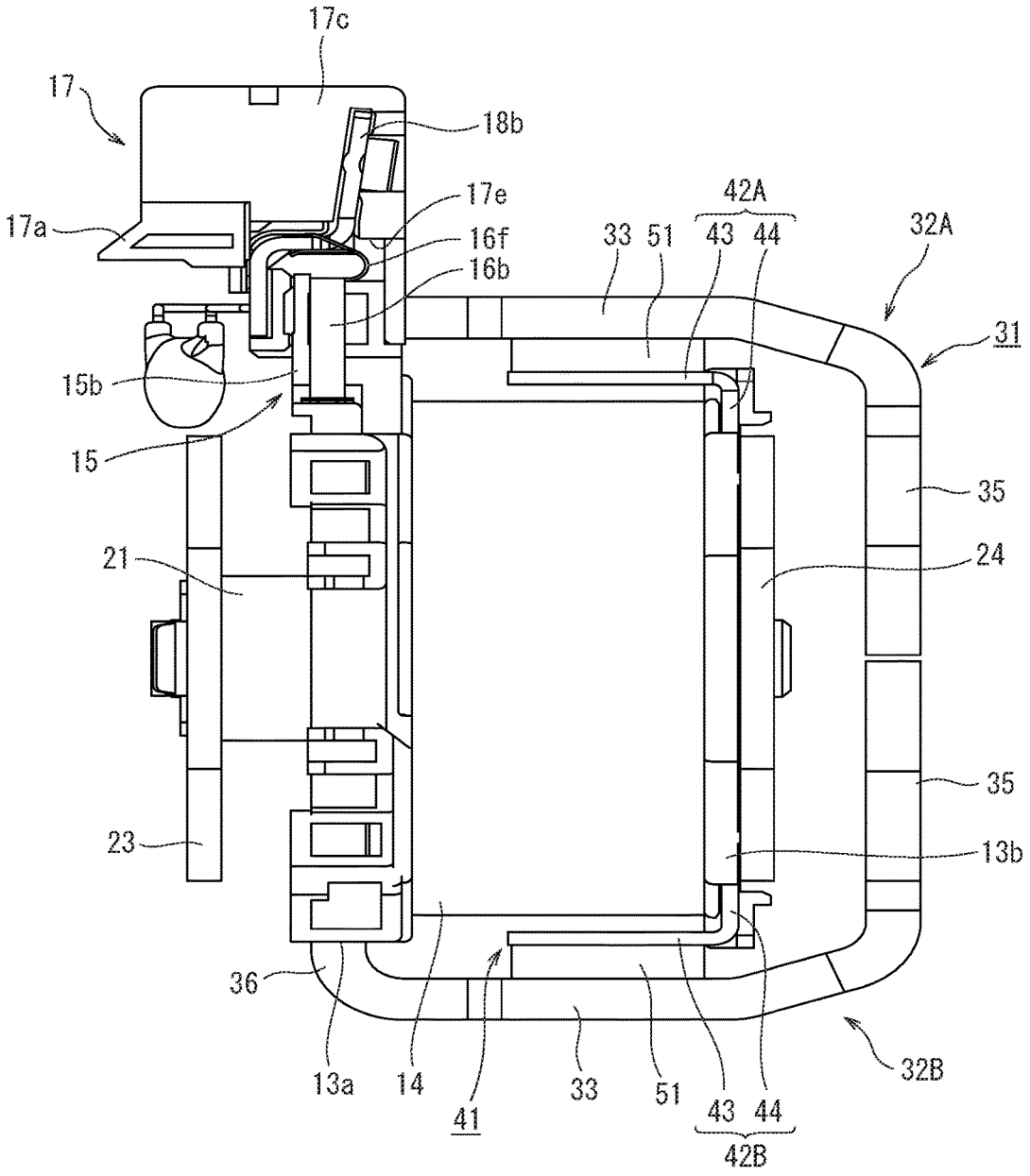
FIG. 2 is a side view of FIG. 1.

As illustrated in FIG. 1 and FIG. 2, a polarized DC electromagnetic device 10 according to the present invention includes a spool 11, a plunger 21, an outer yoke 31, an inner yoke 41, and a permanent magnet 51.

Figure 5:
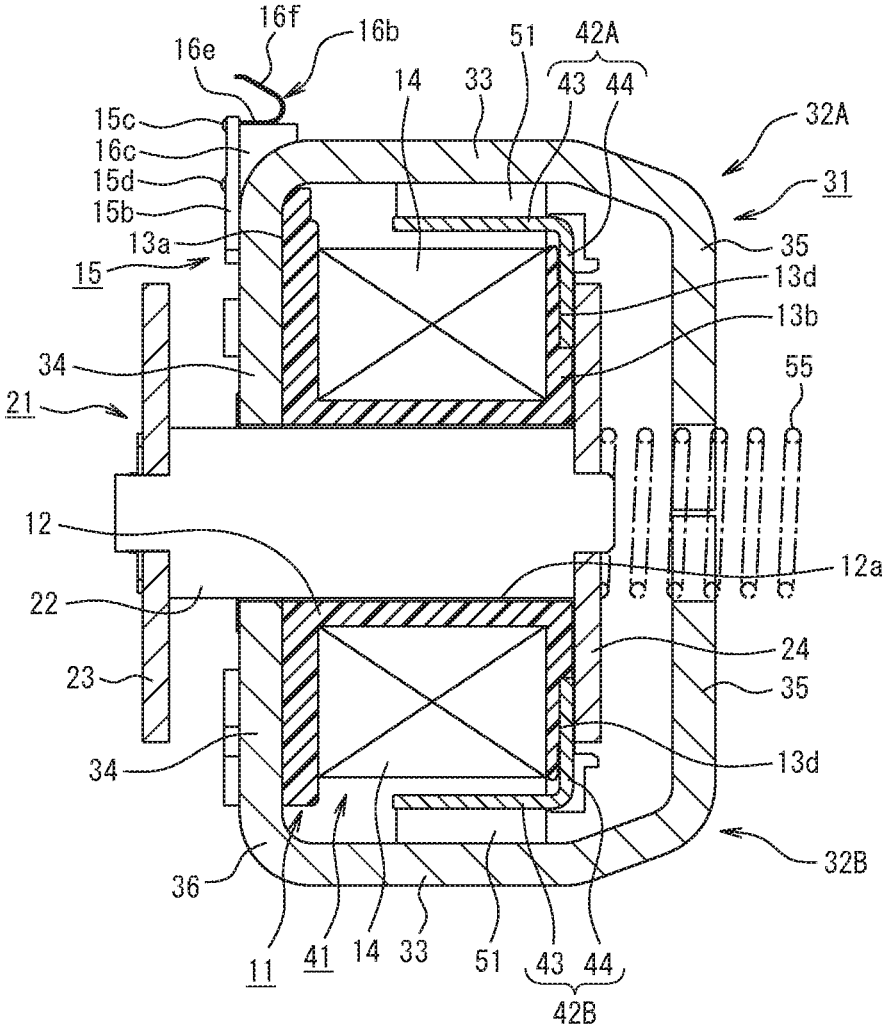
FIG. 5 is a sectional view in which the coil terminal in FIG. 3 is removed.

The spool 11 is formed by injection molding of an insulating resin material such as a thermosetting resin material. As illustrated in FIG. 5, this spool 11 has a circular-cylinder-shaped cylindrical portion 12 having a central opening 12*a*, and substantially rectangular flange portions 13*a* and 13*b* which radially protrude at axial ends, that is, right and left ends of the cylindrical portion 12, respectively. An excitation coil 14 is wound between the flange portions 13*a* and 13*b* on the outer circumferential side of the cylindrical portion 12.

Furthermore, at four corners of the front end face of the flange portion 13*a*, there are formed L-shaped support portions 13*c* which support corner portions on the sides of constricted portions 36 of opposite plate portions 34 of the outer yoke 31 that will be described later. An upwardly protruding coil terminal attachment portion 15 is integrally formed in the flange portion 13*a*. A separately formed coil terminal 17 is attached to the coil terminal attachment portion 15.

Figure 3:
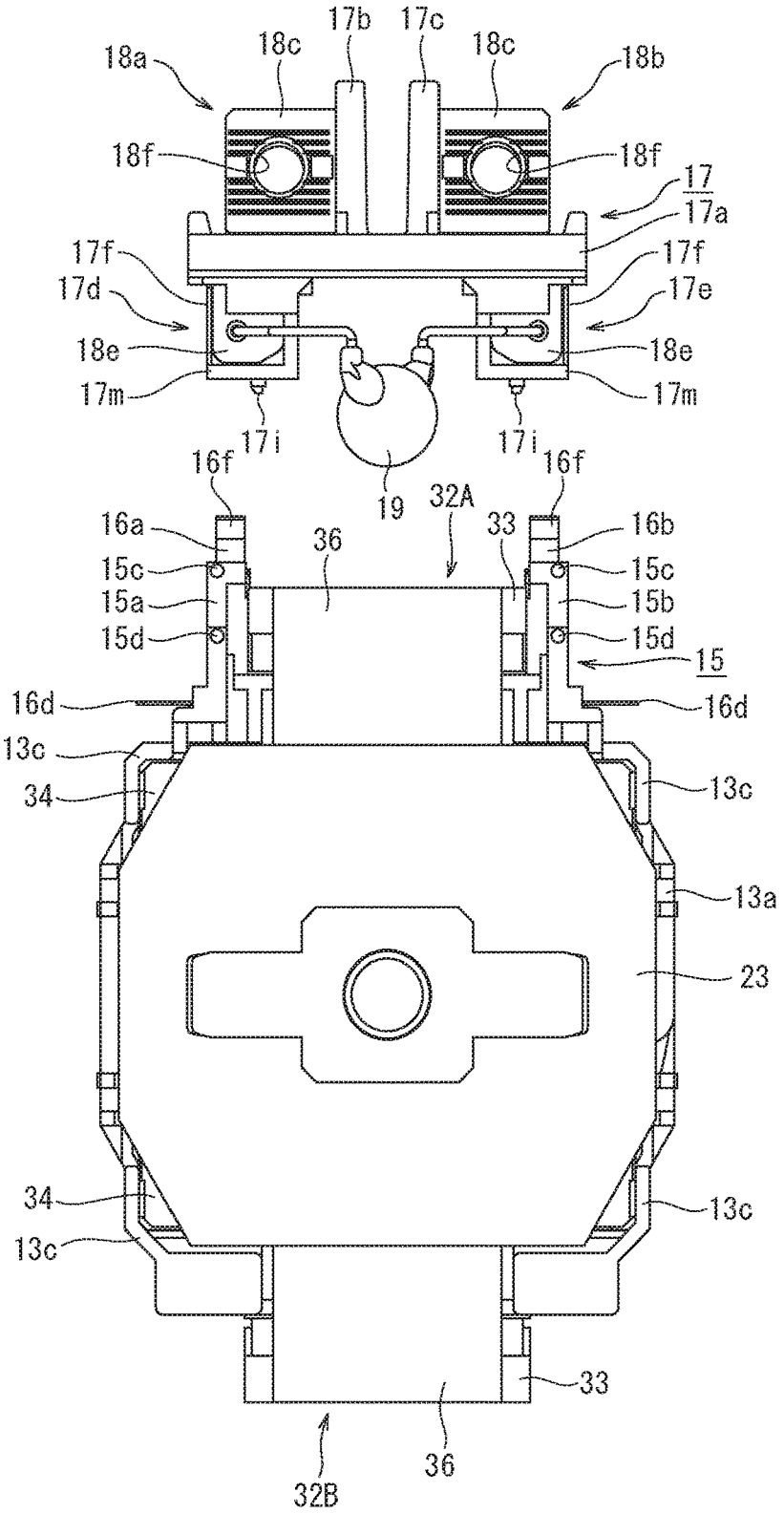
FIG. 3 is a front view in which a coil terminal in FIG. 1 is detached.
Figure 4:
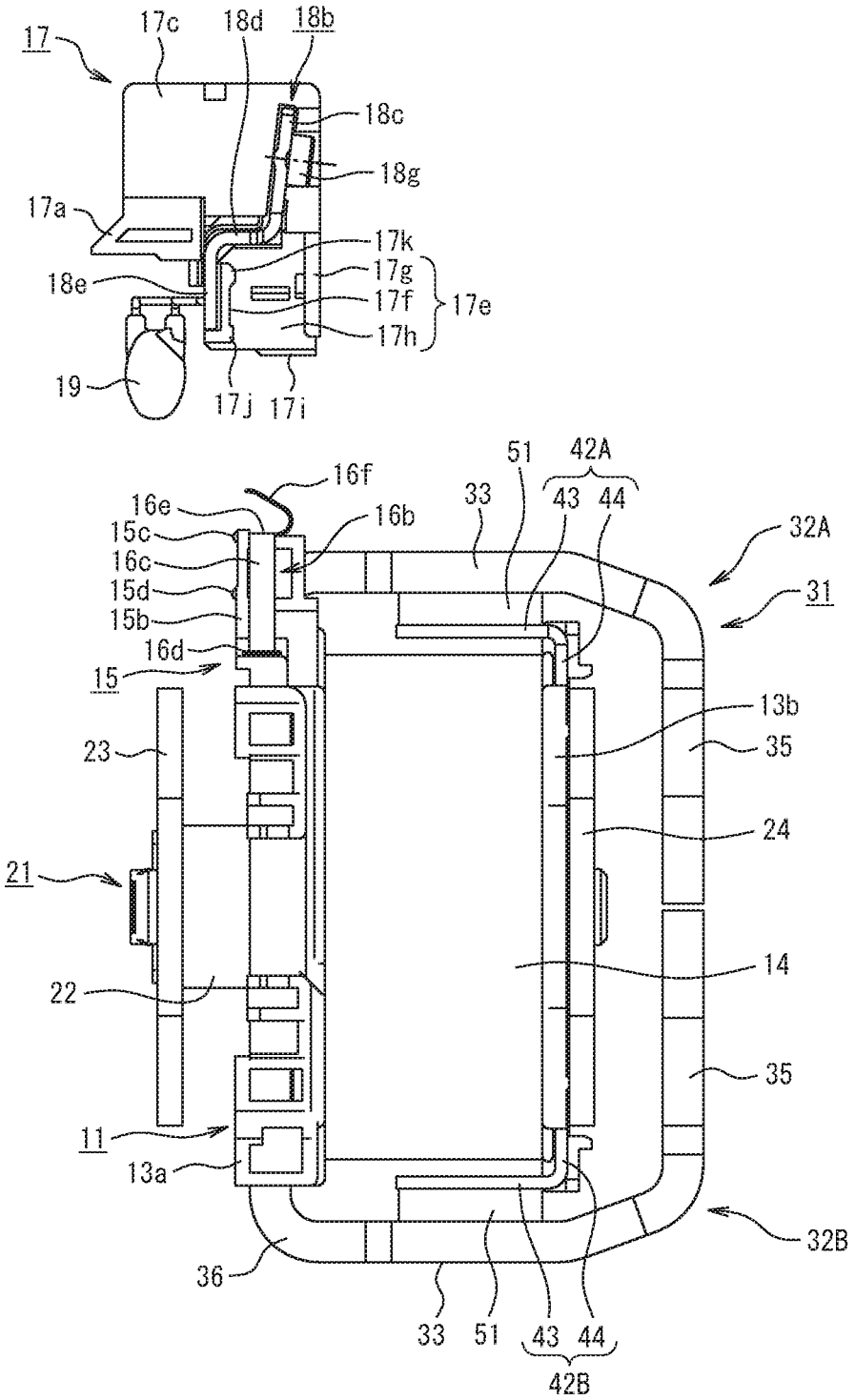
FIG. 4 is a side view in which the coil terminal in FIG. 1 is detached.

The coil terminal attachment portion 15 includes, for example, on the upper side of the flange portion 13*a*, a pair of support pieces 15*a* and 15*b* protrusively formed across a space through which the constricted portion 36 of the outer yoke 31 that will be described later can be inserted. As illustrated in FIG. 3 and FIG. 4, semispherical engaging projections 15*c* and 15*d* are formed in the front surfaces of the support pieces 15*a* and 15*b*, respectively.

Figure 6:
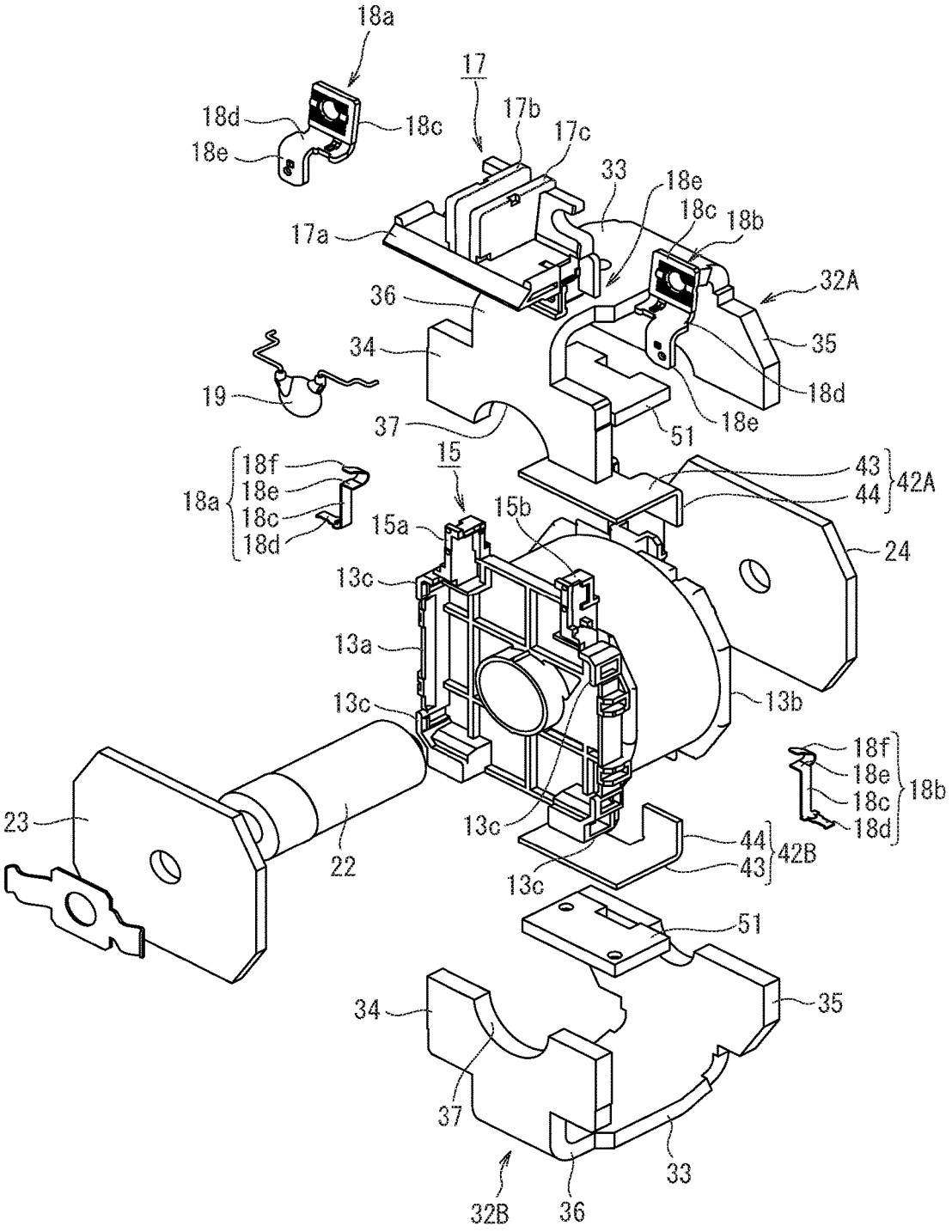
FIG. 6 is an exploded perspective view illustrative of FIG. 1.

Electrically conductive coupling portions 16*a* and 16*b* which serve as binding terminals are attached to the outer side surfaces of the support pieces 15*a* and 15*b*. Each of the electrically conductive coupling portions 16*a* and 16*b* is made of a spring material. As illustrated in FIG. 6, the electrically conductive coupling portions 16*a* and 16*b* respectively include plate portions 16*c* which contact the outsides of the support pieces 15*a* and 15*b* and which extend in an upward-downward direction, binding plate portions 16*d* which contact flange side surfaces on the base portion sides of the support pieces 15*a* and 15*b* formed by being bent outward at one-side ends, that is, lower ends of the plate portions 16*c* and to which a lead wire of the excitation coil 14 is bound, bent plate portions 16*e* which are formed by being bent inward from the other end, that is, upper ends of the plate portions 16*e*, and elastic contact portions 16*f* which extend backward from backward side surfaces of the bent plate portions 16*e* and which are U-shaped.

The coil terminal 17 is injection-molded by an insulating resin material such as a thermosetting resin material, and electrically conductive coil terminal plates 18*a* and 18*b* are attached to the coil terminal 17.

Figure 7A:
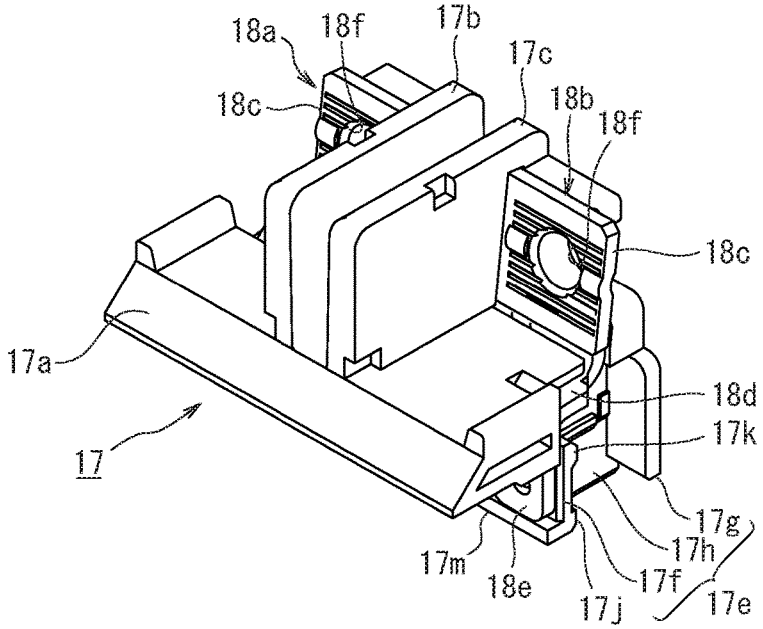
FIGS. 7A to 7B are views illustrative of the coil terminal.
Figure 7B:
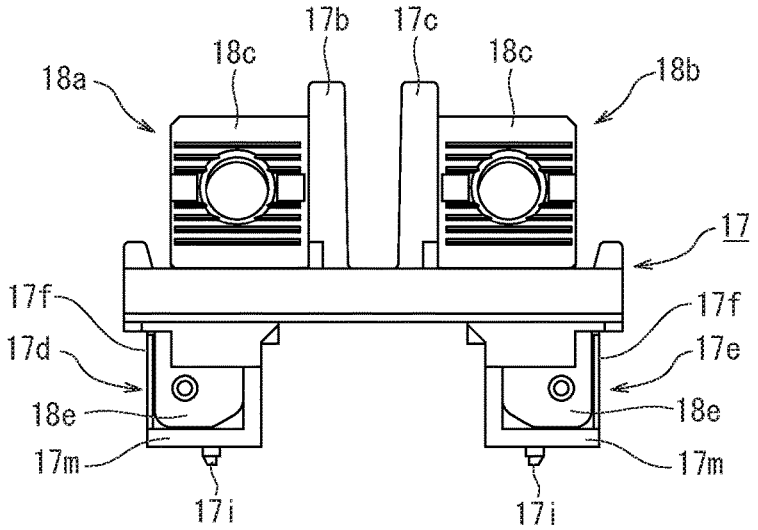
Figure 7C:
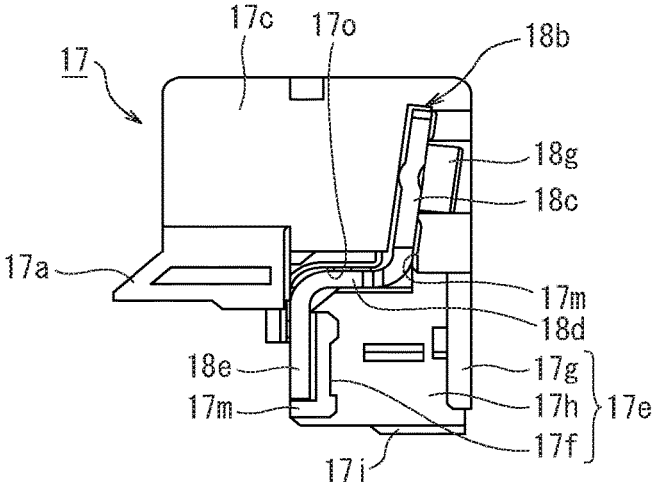
FIG. 7C is a side view.

As illustrated in FIG. 6, FIGS. 7A to 7C, and FIG. 8A, each of the coil terminal plates 18*a* and 18*b* is formed, when seen from the side surface thereof, into a crank shape by an external power source connection portion 18*c* which is connected to an external coil power source, a contact plate portion 18*d* which is bent forward and extends from a lower end of the external power source connection portion 18*c*, and a capacitor connection plate portion 18*e* which is bent downward and extends from a front side step portion of the contact plate portion 18*d*. A through hole 18*f* through which an unshown coupling screw is inserted is formed in the external power source connection portion 18*c*, and an internal thread portion 18*g* into which the coupling screw is put is formed on the back surface side of the through hole 18*f* as illustrated in FIG. 7C.

As illustrated in and FIGS. 7A to 7C and FIGS. 8A and 8B, the coil terminal 17 has a rectangular base plate 17*a* which is parallel to the axial direction of the spool and which extends in a right-left direction, and two parallel insulating partition walls 17*b* and 17*c* which extend in a forward-backward direction are formed in a central portion of the upper surface of the base plate 17*a*.

Figure 8A:
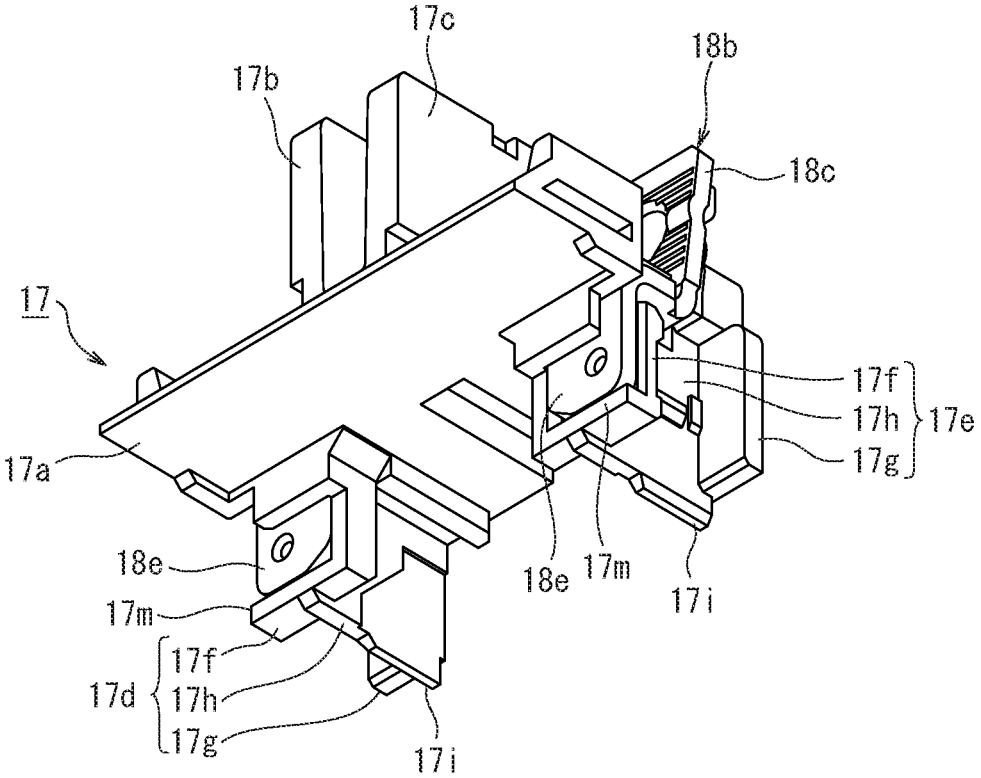
FIGS. 8A and 8B are views illustrative of the coil terminal.
Figure 8B:
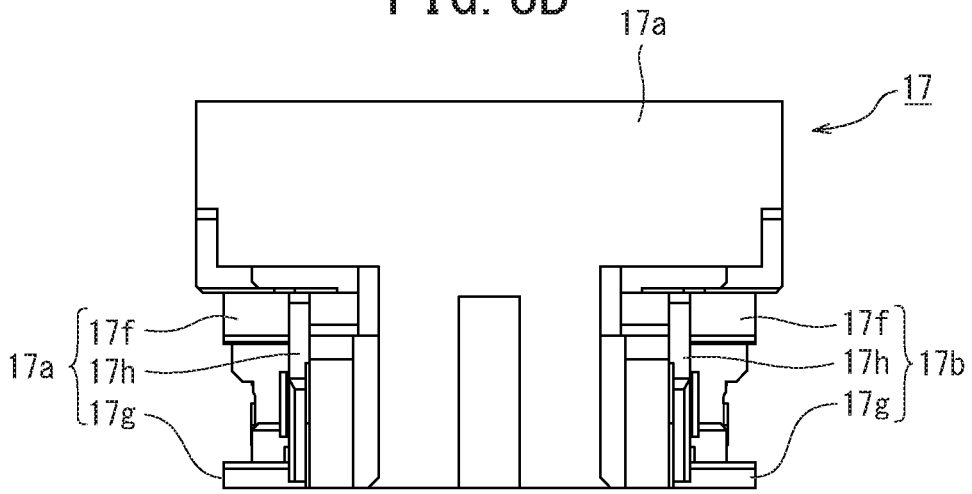

As illustrated in FIG. 8A, fit portions 17*d* and 17*e* which are fitted into the pair of support pieces 15*a* and 15*b* of the coil terminal attachment portion 15 are formed on the lower surface side of the base plate 17*a*. The fit portions 17*d* and 17*e* are constituted of a pair of support plate portions 17*f* and 17*g* which protrude downward parallel to each other with a given space therebetween in the forward-backward direction from the lower surface of the base plate 17*a*, and a coupling plate portion 17*h* which couples inward side ends of the support plate portions 17*f* and 17*g*. A positioning protrusion 17*i* is formed at the front end of the coupling plate portion 17*h*.

In the front side support plate portions 17*f*, engaging projecting portions 17*j* and 17*k* which are engaged with the semispherical engaging projections 15*c* and 15*d* of the coil terminal attachment portion 15 are formed at upper and lower positions with a back-surface given space on the rear surface side. Support portions 17*m* which support the capacitor connection plate portions 18*e* of the coil terminal plates 18*a* and 18*b* so that the capacitor connection plate portions 18*e* are exposed forward are formed on the front surface side of the front side support plate portions 17*f*.

As illustrated in FIG. 7C, in the base plate 17*a*, slits 17*n* through which the sides of the external power source connection portions 18*c* and the contact plate portions 18*d* of the coil terminal plates 18*a* and 18*b* are inserted are formed on the right and left side portions, and slots 17*o* through which the contact plate portions 18*d* are inserted and which expose the lower surfaces of the contact plate portions 18*d* in the fit portions 17*d* and 17*e* are formed on the lower surface side. The front end sides of the slots 17*o* extend to the positions of the support portions 17*m* formed in the support plate portions 17*f* of the fit portions 17*d* and 17*e*.

Therefore, the coil terminal plates 18*a* and 18*b* are supported so that the external power source connection portions 18*c* protrude upward on the base plate 17*a*, the contact plate portions 18*d* are exposed in the fit portions 17*d* and 17*e*, and the capacitor connection plate portions 18*e* are exposed forward in the support plate portions 17*f* of the fit portions 17*d* and 17*e*. A capacitor 19 is electrically and mechanically connected, for example, by soldering between the capacitor connection plate portions 18*e* of the coil terminal plates 18*a* and 18*b*. This prevents the coil terminal plates 18*a* and 18*b* from coming off the base plate 17*a*.

As illustrated in FIG. 3 and FIG. 4, while the fit portions 17*d* and 17*e* face the pair of support pieces 15*a* and 15*b* of the coil terminal attachment portion 15, the support pieces 15*a* and 15*b* are fitted into the fit portions 17*d* and 17*e*, whereby the coil terminal 17 is integrated.

At this time, the support plate portions 17*g* of the fit portions 17*d* and 17*e* contact the back surfaces of the pair of support pieces 15*a* and 15*b*, and the engaging projecting portions 17*j* and 17*k* formed on the back surface side of the fit portions 17*d* and 17*e* are fitted in the semispherical engaging projections 15*c* and 15*d* formed on the front surface side of the pair of support pieces 15*a* and 15*b*. At the same time, the elastic contact portions 16*f* of the electrically conductive coupling portions 16*a* and 16*b* attached to the support pieces 15*a* and 15*b* elastically contact and are thus electrically connected to the contact plate portions 18*d* of the coil terminal plates 18*a* and 18*b* exposed in the fit portions 17*d* and 17*e*.

As illustrated in FIG. 3, the plunger 21 is constituted of a circular-cylinder-shaped rod-like portion 22 which is inserted through the central opening 12*a* of the spool 11, and a first armature 23 and a second armature 24 which protrude from the central opening 12*a* of the rod-like portion 22 and which radially protrusively formed at both ends of the axial direction.

As illustrated in FIG. 1 and FIG. 3, the outer yoke 31 is constituted of a pair of upper and lower yoke halves 32A and 32B facing across the spool 11.

As illustrated in FIG. 6, each of the yoke halves 32A and 32B has a central plate portion 33 extending up and down along the opposite side surfaces of the spool 11, and the opposite plate portions 34 and 35 extending inward from the front and back ends of the central plate portion 33 along the flange portions 13*a* and 13*b* of the spool 11, and is thus C-shaped when seen from the side surface thereof. Here, the constricted portions 36 are formed between the central plate portions 33 and the opposite plate portions 34 and 35. The constricted portion 36 on the opposite plate portion 34 side of the yoke half 32A is inserted between the pair of support pieces 15*a* and 15*b* of the coil terminal attachment portion 15.

As illustrated in FIG. 1, FIG. 4, and FIG. 5, the inner yoke 41 is constituted of yoke halves 42A and 42B disposed with a given space inside the yoke halves 32A and 32B of the outer yoke 31. Each of the yoke halves 42A and 42B is formed into an L-shape by a horizontal plate portion 43 facing the central plate portions 33 of the yoke halves 32A and 32B of the outer yoke 31, and a vertical plate portion 44 disposed in a radially extending slot 13*d* formed on the lower surface side of the flange portion 13*b* of the spool 11 from the lower end side of the horizontal plate portion 43.

As illustrated in FIG. 1 and FIG. 3, the permanent magnets 51 are respectively inserted and disposed between the central plate portions 33 in the yoke halves 32A and 32B of the outer yoke 31 and vertical plate portions 44 in the yoke halves 42A and 42B of the inner yoke 41 facing the central plate portions 33. These permanent magnets 51 are magnetized to an N-pole on the outer sides, and magnetized to an S-pole on the inner sides.

As illustrated in FIG. 1 and FIG. 3, each of the yoke halves 32A and 32B of the outer yoke 31 is disposed so that the upper opposite plate portion 34 is disposed to face the upper end surface of the flange portion 13*a* of the spool 11 and the lower opposite plate portion 35 is disposed at a given distance under the flange portion 13*b* of the spool 11. As illustrated in FIG. 6, semicircular cutouts 37 through which the rod-like portion 22 of the plunger 21 is inserted are formed in the opposite plate portions 34 of the yoke halves 32A and 32B. The thickness (about 3 mm) of the yoke halves 32A and 32B of the outer yoke 31 is set to be larger than the thickness (about 1 mm) of the inner yoke 41 so that the magnetic resistance of the outer yoke 31 is reduced.

Next, an assembly method of the above polarized DC electromagnetic device 10 is described.

First, the second armature 24 is coupled to the back end of the plunger 21. While the vertical plate portions 44 formed in the yoke halves 42A and 42B of the inner yoke 41 holding the permanent magnets 51 are inserted in the slot 13*d* formed in the flange portion 13*b* of the spool 11, the plunger 21 is inserted through the central opening 12*a* of the spool 11 so that the second armature 24 contacts the flange portion 13*b*.

In this state, before the coil terminal 17 is attached to the coil terminal attachment portion 15, the opposite plate portions 34 on the front end sides of the yoke halves 32A and 32B of the outer yoke 31 are attached to the flange portion 13*a* of the spool 11. At this time, the coil terminal 17 is not connected to the coil terminal attachment portion 15, and hence the upper yoke half 32A can be easily attached to the flange portion 13*a*.

That is, the opposite plate portion 34 is fixed to the front end side of the flange portion 13*a* so that the constricted portion 36 of the upper yoke half 32A is inserted between the pair of support pieces 15*a* and 15*b* of the coil terminal attachment portion 15. Since the coil terminal attachment portion 15 is not formed in the lower yoke half 32*b*, the opposite plate portion 34 is directly fixed to the front end side of the flange portion 13*a*.

In this state, the central plate portions 33 of the yoke halves 32A and 32B are attracted to the permanent magnets 51 held to the yoke halves 42A and 42B of the inner yoke 41, and then the yoke halves 42A and 42B are held to the spool 11 without moving in the forward-backward direction, as illustrated in FIG. 4 and FIG. 5.

At this time, a magnetic path in which magnetic fluxes from the N-poles of the permanent magnets 51 reach the S-poles of the permanent magnets 51 from the central plate portions 33 of the yoke halves 32A and 32B via the opposite plate portions 34, the plunger 21, the second armature 24, and the inner yoke 41 is formed so that the second armature 24 is attracted to the vertical plate portions 44 of the yoke halves 42A and 42B of the inner yoke 41.

While the inner yoke 41 and the outer yoke 31 are attached to the spool 11 as above, the coil terminal 17 is attached to the coil terminal attachment portion 15 of the spool 11.

This attachment of the coil terminal 17 causes the fit portions 17*d* and 17*e* of the coil terminal 17 to contact, from above, the ends of the pair of support pieces 15*a* and 15*b* protruding above the coil terminal attachment portion 15. In this state, the coil terminal 17 is lowered so that the pair of support pieces 15*a* and 15*b* are inserted between the pair of support plate portions 17*f* and 17*g* of the fit portions 17*d* and 17*e* facing each other.

The engaging projecting portions 17*j* and 17*k* are then engaged with the engaging projections 15*c* and 15*d* as illustrated in FIG. 7 after the engaging projecting portion 17*j* formed on the back surface side of the support plate portion 17*f* climbs over the semispherical engaging projections 15*c* formed in the front surfaces of the pair of support pieces 15*a* and 15*b*. Furthermore, the coil terminal 17 is lowered so that the positioning protrusion 17*i* formed at the front end of the coupling plate portion 17*h* abuts on the back end face of the opposite plate portion 34 of the yoke half 32A in the outer yoke 31, whereby the attachment of the coil terminal 17 is completed, and the polarized DC electromagnetic device 10 is configured as illustrated in FIG. 1 and FIG. 2.

At this time, the elastic contact portions 16*f* of the electrically conductive coupling portions 16*a* and 16*b* attached to the pair of support pieces 15*a* and 15*b* of the coil terminal attachment portion 15 elastically contact and are thus electrically connected to the contact plate portions 18*d* of the coil terminal plates 18*a* and 18*b* exposed in the fit portions 17*d* and 17*e* of the coil terminal 17.

Next, an operation in a first embodiment is described.

First, an external DC power source is connected to the external power source connection portions 18*c* of the coil terminal plates 18*a* and 18*b* in the coil terminal 17 of the polarized DC electromagnetic device 10 via a switch that is not illustrated. In this state, it is considered that the switch is off and that no DC electric power is supplied to the coil terminal 17 and the excitation coil 14 is in an electrically nonconductive state.

In this state, the second armature 24 is urged toward the flange portion 13*b* of the spool 11 by a return spring 55 illustrated by a chain line in FIG. 5, and then brought closer to the vertical plate portions 44 in the yoke halves 42A and 42B of the inner yoke 41.

Consequently, a magnetic path in which the magnetic fluxes of the permanent magnets 51 are transmitted to the front-end-side opposite plate portions 34 from the central plate portions 33 of the yoke halves 32A and 32B of the outer yoke 31, pass through the plunger 21 from the opposite plate portions 34, and reach the permanent magnets 51 from the second armature 24 through the vertical plate portion 44 and the horizontal plate portion 43 of the inner yoke 41 is formed so that the second armature 24 is attracted to the vertical plate portions 44 of the yoke halves 42A and 42B of the inner yoke 41.

Thus, as illustrated in FIG. 1 and FIG. 2, the first armature 23 of the plunger 21 is at a non-excitation position located forward apart from the opposite plate portion 34 in each of the yoke halves 32A and 32B of the outer yoke 31.

When the switch is turned on from this non-excitation position to supply DC electric power to the external power source connection portions 18*c* in the coil terminal plates 18*a* and 18*b* of the coil terminal 17 so that the excitation coil 14 is electrically conducted, the excitation coil 14 is excited in a polarity reverse to that of the permanent magnet 51. As a result, a magnetic flux flows in the plunger 21 from its lower end side to its upper end side. This magnetic flux flows from the upper opposite plate portion 34 of each of the yoke halves 32A and 32B of the outer yoke 31 close to the upper end side of the plunger 21 to the lower opposite plate portion 35 through the central plate portion 33.

Thus, attraction force works between the first armature 23 and the second armature 24 formed in the plunger 21 and the front and back opposite plate portions 34 and 35 in the yoke halves 32A and 32B of the outer yoke 31. At the same time, repulsion is generated between the lower second armature 24 and the opposite plate portion 35 of each of the yoke halves 42A and 42B of the inner yoke 41.

Thus, the plunger 21 moves backward against the return spring 55 to an excitation position where the first armature 23 and the second armature 24 are attracted to the opposite plate portion 35 side of each of the yoke halves 32A and 32B of the outer yoke 31.

In this way, when the excitation coil 14 is brought into the electrically conducted state and thus brought into an excited state, a magnetic flux running from the back side to the front side flows through the plunger 21. However, since low magnetic resistance of each of the yoke halves 32A and 32B of the outer yoke 31 is set, this magnetic flux also flows to the sides of the yoke halves 32A and 32B, and a concentrated magnetic flux which is formed in the plunger 21 is dispersed to the yoke halves 32A and 32B so that the magnetic flux density balance is optimized.

Thus, electromagnetic efficiency is improved, and the number of winding of the excitation coil 16 which is wound around the spool 11 can be reduced when the same operation force is to be obtained by the plunger 21. Therefore, the polarized DC electromagnetic device 10 can be reduced in size, and a configuration to obtain operation force equivalent to that of an alternating-current operation electromagnetic device can be formed into a size equal to that of the alternating-current operation electromagnetic device to achieve a cost reduction.

The area in which the opposite plate portions 34 and 35 of each of the yoke halves 32A and 32B of the outer yoke 31 face the first armature 23 and the second armature 24 of the plunger 21 is set to be larger than that of the central plate portion 33, so that the magnetic resistance is reduced, and the magnetic flux can be satisfactorily transmitted between the yoke halves.

Furthermore, the thickness of the outer yoke 31 is set to about three times the thickness of the inner yoke 41, and the magnetic resistance of the outer yoke 31 is set to be lower than the magnetic resistance of the inner yoke 41. Therefore, it is possible to certainly prevent the magnetic flux having a polarity reverse to that of the permanent magnet 51 from flowing backward through the permanent magnet 51 when the excitation coil 14 is excited.

In addition, the coil terminal 17 which is attached to the coil terminal attachment portion 15 of the spool 11 is separately configured, so that the yoke half 32A which constitutes the outer yoke 31 can be easily attached to the flange portion 13*a* of the spool 11 before the coil terminal 17 is attached to the coil terminal attachment portion 15, and the polarized DC electromagnetic device 10 can be configured when the coil terminal 17 is attached to the coil terminal attachment portion 15 later.

Thus, the assembly efficiency of the polarized DC electromagnetic device 10 can be improved, and the width of the region of the spool 11 between the coil terminal attachment portion 15 and the coil terminal 17 through which the yoke half 32A is inserted does not need to be increased, and the width when the coil terminal 17 is attached to the coil terminal attachment portion 15 can be smaller. It is therefore possible to improve the assembly efficiency of the polarized DC electromagnetic device 10 and still reduce the maximum height thereof to achieve a size reduction.

Both winding-start and winding-end ends of the excitation coil 14 are bound to the electrically conductive coupling portions 16*a* and 16*b* attached to the pair of support pieces 15*a* and 15*b* of the coil terminal attachment portion 15.

When the width when the coil terminal 17 is attached to the coil terminal attachment portion 15, the elastic contact portions 16*f* formed at the ends of the electrically conductive coupling portions 16*a* and 16*b* elastically contact the contact plate portions 18*d* of the coil terminal plates 18*a* and 18*b* exposed in the fit portions 17*d* and 17*e* of the coil terminal 17. It is thus possible to electrically connect the excitation coil 14 and the coil terminal plates 18*a* and 18*b* with ease only by attaching and fitting the coil terminal 17 to the coil terminal attachment portion 15.

Next, a second embodiment in which the polarized DC electromagnetic device 10 mentioned above is applied to an electromagnetic contactor according to the present invention is described with reference to the FIG. 9 to FIG. 12.

Figure 9:
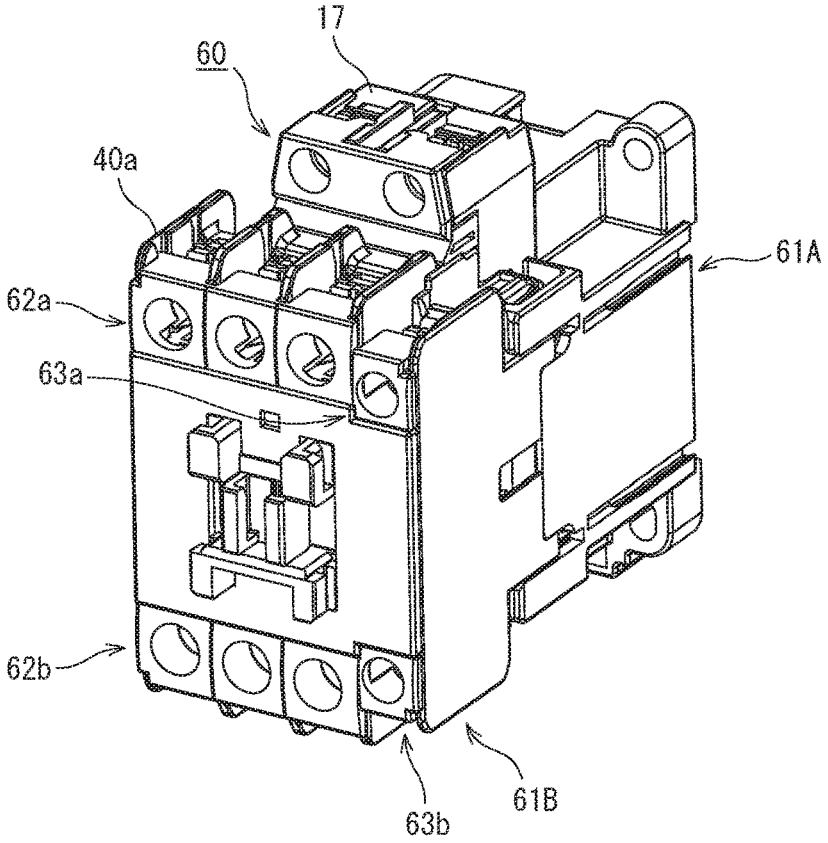
FIG. 9 is an appearance perspective view illustrative of one configuration of an electromagnetic contactor according to the present invention.

As illustrated in FIG. 9, an electromagnetic contactor 60 according to this second embodiment is constituted of a first frame 61A and a second frame 61B coupled to each other.

Figure 11:
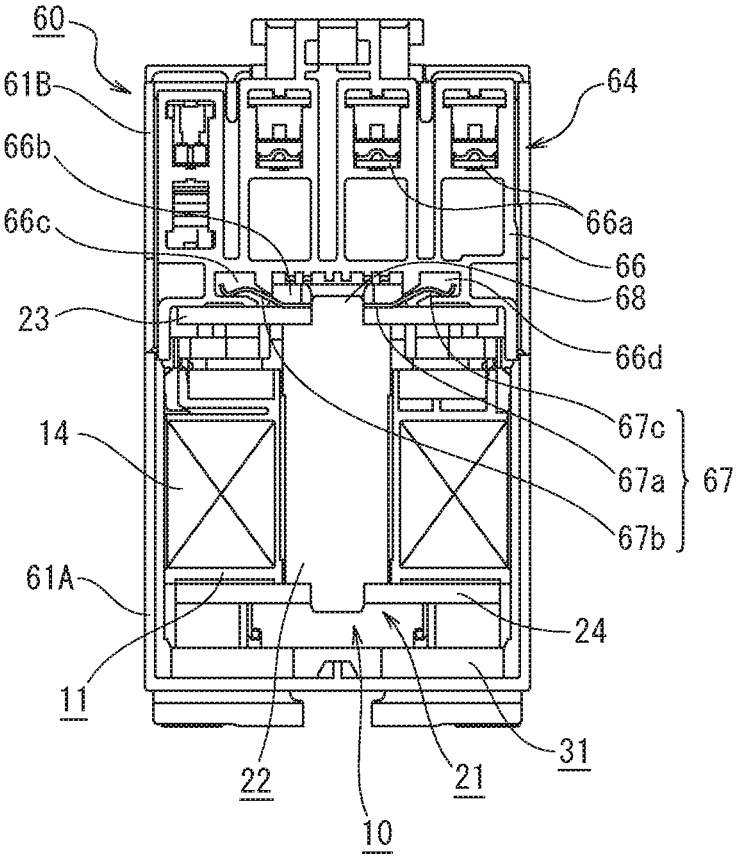
FIG. 11 is a sectional view taken along the line XI-XI of FIG. 7.
Figure 12:
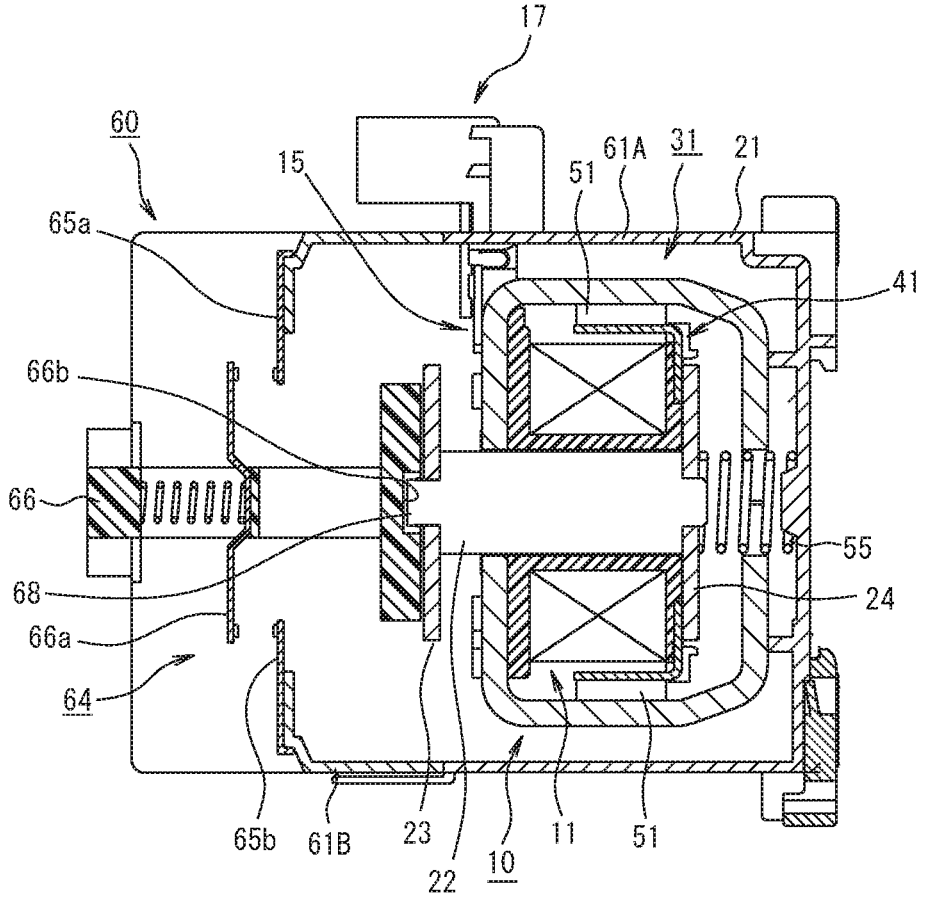
FIG. 12 is a sectional view taken along the line XII-XII of FIG. 7.

The polarized DC electromagnetic device 10 described in the above first embodiment is internally attached to the first frame 61A as illustrated in FIG. 11 and FIG. 12, and parts equivalent to those in the first embodiment are denoted by the same reference marks and are not described in detail.

Figure 10:
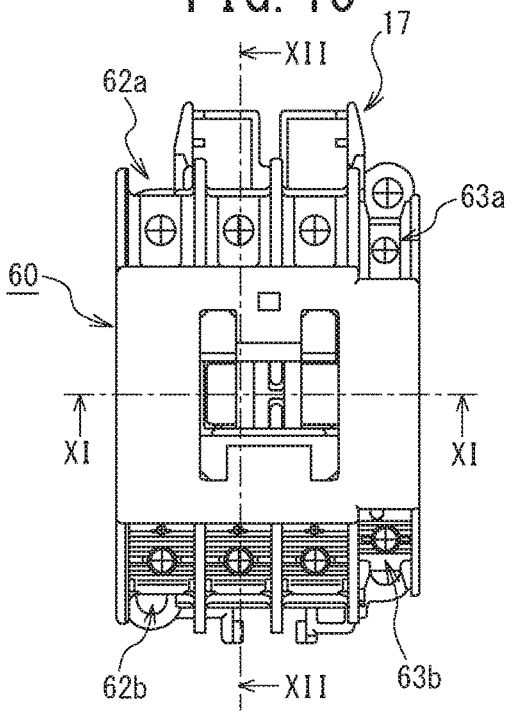
FIG. 10 is a front view of FIG. 7.

As illustrated in FIG. 9 and FIG. 10, in the second frame 61B, a main circuit power source side terminal 62*a* and an auxiliary terminal 63*a* which are connected to a three-phase alternating-current power source are formed, for example, on the upper end side of the front end, and a main circuit load side terminal 62*b* and an auxiliary terminal 63*b* which are connected to a three-phase load such as a three-phase electric motor are formed on the lower end side of the front end.

A contact mechanism 64 which is turned on and off and driven by the polarized DC electromagnetic device 10 is internally attached to the second frame 61B.

As illustrated in FIG. 12, the contact mechanism 64 includes a first fixed contact 65*a* individually connected to the main circuit power source side terminal 62*a* and the auxiliary terminal 63*a* and a second fixed contact 65*b* individually connected to the main circuit load side terminal 62*b* and the auxiliary terminal 63*b*, and a contact support 66 which holds a movable contact 66*a* disposed to be able to come in and out of contact between the first fixed contact 65*a* and the second fixed contact 65*b*.

As illustrated in FIG. 11 and FIG. 12, the contact support 66 is coupled to the plunger 21 of the polarized DC electromagnetic device 10. That is, a coupling spring 67 is fixed by a caulking portion 68 to the upper surface of the first armature 23 formed in the plunger 21. Thus coupling spring 67 is constituted of a central flat plate portion 67*a*, and upwardly projecting curved plate portions 67*b* and 67*c* formed at right and left ends of the flat plate portion 67*a*.

On the other hand, as illustrated in FIG. 11 and FIG. 12, on the back end surface of the contact support 66, there are formed a space portion 66*b* through which the caulking portion 68 to fix the coupling spring 67 of the plunger 21 is inserted, and spring housing portions 66*c* and 66*d* formed at right and left ends of the space portion 66*b* to insert and hold the curved plate portions 67*b* and 67*c* of the coupling spring 67.

The curved plate portions 67*b* and 67*c* of the coupling spring 67 fixed to the upper surface of the first armature 23 are then inserted into the spring housing portions 66*c* and 66*d* of the contact support 66, whereby the plunger 21 and the contact support 66 are coupled to each other.

Next, an operation in the above second embodiment is described. While the excitation coil 14 of the polarized DC electromagnetic device 10 is in the electrically nonconductive state and the plunger 21 is at the non-excitation position, the contact support 66 abuts on the inner side of the front end of the second frame 61B so that the movable contact 66*a* is located forward apart from the first fixed contact 65*a* and the second fixed contact 65*b* as illustrated in FIG. 12. In this state, the main circuit power source side terminal 62*a* and the main circuit load side terminal 62*b* of each phase are at open positions where these terminals are electrically disconnected.

From this state, the excitation coil 14 of the polarized DC electromagnetic device 10 is electrically conducted and thus brought into the excited state so that the plunger 21 is moved backward, and the contact support 66 that is coupled by the coupling spring 67 is also moved backward at the same time. Thus, the movable contact 66*a* of each phase contacts the first fixed contact 65*a* and the second fixed contact 65*b* of each phase so that the main circuit power source side terminal 62*a* and the main circuit load side terminal 62*b* are brought into a closed state where these terminals are electrically connected via the movable contact 66*a*.

In this way, according to the second embodiment, the contact support 66 can be moved by the polarized DC electromagnetic device 10 described above in the first embodiment, and the polarized DC electromagnetic device 10 can be as small-sized as a normal alternating-current operation electromagnetic device which generates the same operation force. Hence, it is possible to reduce the height of the first frame 61A which houses this polarized DC electromagnetic device 10.

Therefore, the length of the whole electromagnetic contactor 60 in the forward-backward direction can be reduced, and the height of the polarized DC electromagnetic device 10 up to the end of the coil terminal 17 can be reduced as described above. It is thus possible to reduce the length of the electromagnetic contactor 60 in the forward-backward direction and the upward-downward direction, and reduce the electromagnetic contactor 60 in size.

Moreover, the assembly efficiency of the polarized DC electromagnetic device 10 can be improved, and hence the assembly efficiency of the electromagnetic contactor 60 can also be improved.

REFERENCE SIGNS LIST

10 . . . polarized DC electromagnetic device, 11 . . . spool, 12*a* . . . central opening, 12 . . . cylindrical portion, 13*a* and 13*b* . . . flange portions, 14 . . . excitation coil, 15 . . . coil terminal attachment portion, 15*a* and 15*b* . . . support pieces, 16*a* and 16*b* . . . electrically conductive coupling portions, 16*f* . . . elastic contact portion, 17 . . . coil terminal, 17*a* . . . base plate, 17*d* and 17*e* . . . fit portions, 18*a* and 18*b* . . . coil terminal plates, 21 . . . plunger, 22 . . . rod-like portion, 23 . . . first armature, 24 . . . second armature, 31 . . . outer yoke, 32A and 32B . . . yoke halves, 33 . . . central plate portion, 34 and 35 . . . opposite plate portions, 41 . . . inner yoke, 42A and 42B . . . yoke halves, 43 . . . horizontal plate portion, 44 . . . vertical plate portion, 51 . . . permanent magnet, 55 . . . return spring, 60 . . . electromagnetic contactor, 61A . . . first frame, 61B . . . second frame, 62*a* . . . main circuit power source side terminal, 62*b* . . . main circuit load side terminal, 63*a* and 63*b* . . . auxiliary terminals, 66 . . . contact support, 66*a* . . . movable contact, 66*b* . . . space portion, 66*c* and 66*d* . . . spring housing portions, and 67 . . . coupling spring.

The invention claimed is:

1. A polarized DC electromagnetic device comprising:

a spool around which an excitation coil is wound;

a plunger which is inserted through a cylindrical portion of the spool and in which a first armature and a second armature are individually attached to both ends protruding from the cylindrical portion;

an outer yoke which surrounds opposite side surfaces of the spool so as to attract the first armature and the second armature;

an inner yoke disposed inside the outer yoke so as to attract the second armature; and a permanent magnet disposed between the outer yoke and the inner yoke, wherein the spool comprises radially protruding flange portions which are respectively formed at both ends of the cylindrical portion, a coil terminal attachment portion formed in the flange portion on the first armature side, and a coil terminal which is attached to the coil terminal attachment portion, wherein the coil terminal attachment portion comprises a pair of support pieces radially protrusively formed from the flange portion with a space such that the outer yoke is inserted the space, and an electrically conductive coupling portion in which one end of the excitation coil is connected to one end attached to the pair of support pieces and which has, at the other end, elastic contact portions protruding from ends of the pair of support pieces.

2. A polarized DC electromagnetic device comprising:

a spool around which an excitation coil is wound;

a plunger which is inserted through a cylindrical portion of the spool and in which a first armature and a second armature are individually attached to both ends protruding from the cylindrical portion, an outer yoke which surrounds opposite side surfaces of the spool so as to attract the first armature and the second armature;

an inner yoke disposed inside the outer yoke so as to attract the second armature; and a permanent magnet disposed between the outer yoke and the inner yoke, wherein the spool comprises radially protruding flange portions which are respectively formed at both ends of the cylindrical portion, a coil terminal attachment portion formed in the flange portion on the first armature side, and a coil terminal which is attached to the coil terminal attachment portion, wherein the coil terminal attachment portion comprises a pair of support pieces radially protrusively formed from the flange portion with a space such that the outer yoke is inserted the space, and an electrically conductive coupling portion in which one end of the excitation coil is connected to one end attached to the pair of support pieces and which has, at the other end, elastic contact portions protruding from ends of the pair of support pieces, and wherein the coil terminal comprises a pair of fit portions into which the pair of support pieces of the coil terminal attachment portion are individually fitted, and coil terminal plates disposed to partly face bottom portions of the pair of fit portions so that the coil terminal plates contact the elastic contact portions.

3. An electromagnetic contactor using the polarized DC electromagnetic device according to claim 1 as an operating electromagnet which performs an opening-closing operation of a movable contact of a contact mechanism.

4. An electromagnetic contactor using the polarized DC electromagnetic device according to claim 2 as an operating electromagnet which performs an opening-closing operation of a movable contact of a contact mechanism.

* * * * *